US005823366A

United States Patent [19]

Bellamy

[11] Patent Number: 5,823,366

[45] Date of Patent: Oct. 20, 1998

[54] BATHTUB CADDY

[76] Inventor: David M. Bellamy, 6200 Fair Oaks Rd. S.E. Lot # 77, Olympia, Wash. 98513

[21] Appl. No.: 902,067

[22] Filed: Jul. 29, 1997

Related U.S. Application Data

[60] Provisional application No. 60/022,759 Jul. 29, 1996.

[51] Int. Cl. [6] ..... A47F 5/00

[52] U.S. Cl. ..... 211/119.011; 211/85.25; 211/41.4; D6/525

[58] Field of Search ..... 211/86.01, 119.009, 211/119.011, 85.25, 88.01, 41.3, 41.4, 119, 106, 133.5, 133.6; D6/525

[56] References Cited

U.S. PATENT DOCUMENTS

| | | | |
|---|---|---|---|
| D. 247,013 | 1/1978 | Pierchalski . | |
| D. 265,152 | 6/1982 | Bruno et al. | D6/525 |
| D. 280,788 | 10/1985 | Levin . | |
| D. 335,232 | 5/1993 | Whitlock . | |
| D. 362,777 | 10/1995 | Emery et al. . | |
| 604,803 | 5/1898 | Strauss . | |
| 2,183,441 | 12/1939 | Bentz . | |
| 2,309,851 | 2/1943 | Kuhne | 211/85.25 |
| 2,323,454 | 7/1943 | Chambers | 211/41.4 X |
| 2,659,491 | 11/1953 | Williams | 211/119.011 |
| 2,704,907 | 3/1955 | Durkee . | |
| 3,389,408 | 6/1968 | Pearson | 211/119.011 X |
| 3,834,782 | 9/1974 | Pampinella . | |
| 3,869,183 | 3/1975 | Frank, Jr. . | |
| 4,939,799 | 7/1990 | Van Hovel | D6/525 |
| 5,242,064 | 9/1993 | Martell . | |
| 5,299,683 | 4/1994 | Poole . | |

FOREIGN PATENT DOCUMENTS

| | | |
|---|---|---|
| 587878 | 12/1959 | Canada . |
| 656613 | 1/1963 | Canada . |
| 2060374 | 5/1981 | United Kingdom . |

*Primary Examiner*—Robert W. Gibson, Jr.
*Attorney, Agent, or Firm*—Richard C. Litman

[57] ABSTRACT

A bathtub caddy is disclosed for supporting items such as a cup, soap, towels, and magazines alongside a bathtub. The bathtub caddy includes a base member and a cross-member having a first and second end. The cross-member is oriented such that the first end is attached to the central portion of the base member. The second end of the cross-member projects perpendicularly from the plane of the base member and in a downward direction. A frame assembly is secured to the second end of the cross-member, and a rack is secured to the frame assembly. A tray is removably secured to the base member and provides storage area for bath accessories, while a rack provides storage for items such as reading materials. The caddy may be adjustably secured to the side of bathtubs of varying sizes.

8 Claims, 5 Drawing Sheets

BATHTUB CADDY

CROSS-REFERENCE TO RELATED APPLICATION

This application claims the benefit of U.S. Provisional Patent Application Ser. No. 60/022,759, filed Jul. 29, 1996.

BACKGROUND OF THE INVENTION

1. Field of the Invention

The present invention relates to support devices and more particularly to a caddy device suited for placement on the side of a bathtub.

2. Description of the Related Art

Caddies and related support devices for use in the bathroom are well known. Many such caddies are readily mountable to the bathtub or adjacent structures. The caddy provides a convenient and efficient location for storing accessories which are often used in the tub or while taking a shower. Such accessories often include shaving accessories and the like.

Various such caddies are disclosed in the related literature. For example, U.S. Pat. No. 604,803, issued on May 31, 1898 to Strauss, discloses a bathtub attachment, capable of being secured to the side of the bathtub with a spring clamp. The attachment is suited for holding articles such as soap, brushes, combs, or sponges.

U.S. Pat. No. 2,183,441, issued on Dec. 12, 1939 to Bentz, discloses a vanity or similar attachment for bathtubs. The device includes an arched clamp capable of straddling the side wall of a bathtub. The arched clamp includes a crown provided with a rigid upstanding cylindrical stud. A bearing sleeve having a horizontally projecting neck rotatably surrounds the stud. A horizontal plate having upstanding flanges is joined to the neck via the flanges. An elongated tray is subsequently secured to the plate and flanges.

U.S. Pat. No. 2,704,907, issued on Mar. 29, 1955 to Durkee, discloses a soap receptacle which includes a container portion and a tray portion. The tray portion includes drain holes so that soap contained therein may be dried. Hooks are also provided for attaching the soap receptacle to the side of a bathtub.

U.S. Pat. No. 3,834,782, issued on Sep. 10, 1974 to Pampinella, discloses a toilet article container mountable to a vertical wall by means of a bracket which is swingable to and from the wall from a position parallel to the lengthwise edges, or longitudinal axis, of the bathtub to a position transverse thereto. The article container is rotatable relative to the bracket between a first position wherein the opening to its interior is disposed in a horizontal plane and a second position wherein the opening is disposed in a vertical plane. Means are provided for releasably locking the container in selected planes.

U.S. Pat. No. 3,869,183, issued on Mar. 4, 1975 to Frank, Jr., discloses a shower bath caddy which serves as a container for toilet articles such as a mirror, shaving cream dispenser, a razor, shampoo container, etc. The caddy includes a supporting bracket having suction cups thereon for securing it to the wall of the shower enclosure. The caddy also includes a cabinet mounted for rotation relative to the bracket.

U.S. Pat. No. 5,242,064, issued on Sep. 7, 1993 to Martell, discloses a combination self-draining soap holder and utility shelf which includes a series of ribs and spaces which drain excess water and residue thereby making it easy to grasp and retrieve soap and other bath articles even when wet.

U.S. Pat. No. 5,299,683, issued on Apr. 5, 1994 to Poole, discloses a shower caddy which includes a rigid, hinged, two-part external case. A plurality of holders for toilet articles are disposed within and fastened to the interior of the case. Fluid dispensing means are arranged within and fastened to the case. The shower caddy also includes hinged rotatable hook members which extend from one part of the case to engage with a shower curtain support rod and permit hanging of the case.

U.S. Pat. No. Des. 191,573, issued on Oct. 17, 1961 to Pierchalski, U.S. Pat. No. Des. 247,013, issued on Jan. 24, 1978 to Chapman, U.S. Pat. No. Des. 280,788, issued on Oct. 1, 1985 to Levin, U.S. Pat. No. Des. 335,232, issued on May 4, 1993 to Whitlock, and U.S. Pat. No. Des. 362,777, issued on Oct. 3, 1995 to Emery et al., all disclose various ornamental designs for shower and bathtub attachments.

Canadian Patent No. 587,878, issued on Dec. 1, 1959 to Simmons, discloses a soap holder including a housing of a pleasant style or design, wherein the soap bar may be stored. The housing includes means for supporting the soap bar, and collecting moisture and dissolved material therefrom and hiding it from view.

Canadian Patent No. 656,613, issued on Jan. 29, 1963 to Hawk et al., discloses a bar soap holder for supporting a cake of soap upon a base and within a retaining member which is open at its top and bottom. The bar soap holder is pivotally mounted upon the base so that the cake of soap may be retained against inadvertent movement out of the base, but may easily be removed therefrom when the soap retaining member is swung laterally upon its pivot axis.

U.K. Patent Application 2 060 374, published May 7, 1981 to Moontasir discloses a soap holder, designed to be fastened to a wall. The soap holder includes a lever for pushing a bar of soap off the holder into an user's hand.

None of the above inventions and patents, taken either singly or in combination, is seen to describe the instant invention as claimed.

SUMMARY OF THE INVENTION

Accordingly, it is a principal object of the invention to provide a caddy for conveniently retaining various useful items on the side of a bathtub.

It is another object of the invention to provide a caddy which includes a rack suited for holding reading materials.

It is a further object of the invention to provide a caddy capable of being attached to a variety of sizes of bathtubs.

It is an object of the invention to provide improved elements and arrangements thereof in an apparatus for the purposes described which is inexpensive, dependable and fully effective in accomplishing its intended purposes.

In accordance with the objects of the invention, a caddy is provided for supporting a plurality of items alongside a bathtub. The caddy includes a base member and a cross-member. The cross-member has an L-shaped configuration and includes a first and second end. Furthermore, the cross-member is oriented such that the first end is attached to the central portion of the base member. The second end of the cross-member projects perpendicularly from the plane of the base member and in a downward direction.

A frame assembly is secured to the second end of the cross-member, and a rack is secured to the frame assembly. A tray is removably secured to the base member and provides storage area for bath accessories. The rack provides storage for items such as reading materials. Means are provided for adjustably securing the caddy to the side of bathtubs of varying sizes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
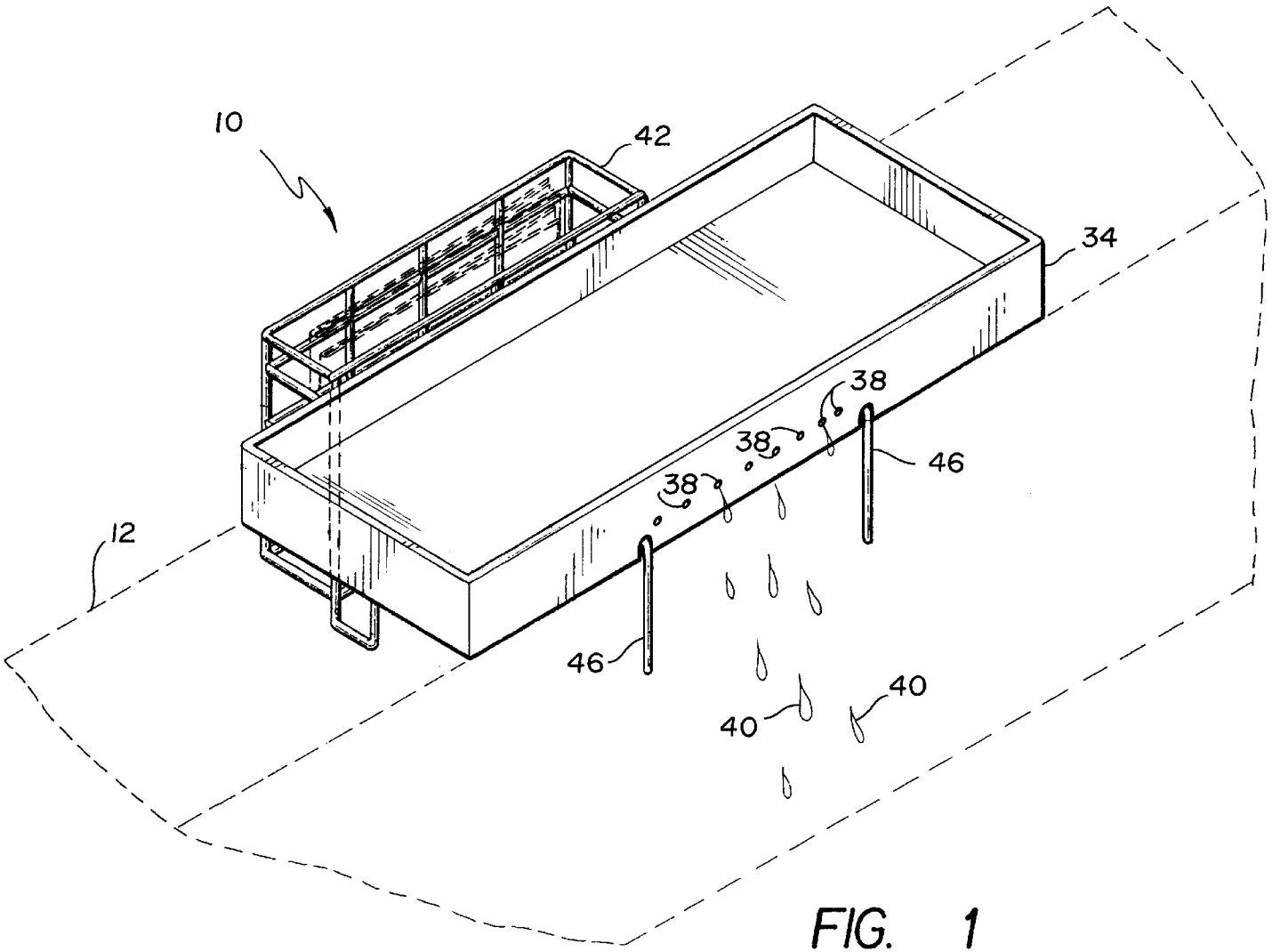
FIG. 1 is perspective environmental view of a bathtub caddy according to the present invention.
Figure 2:
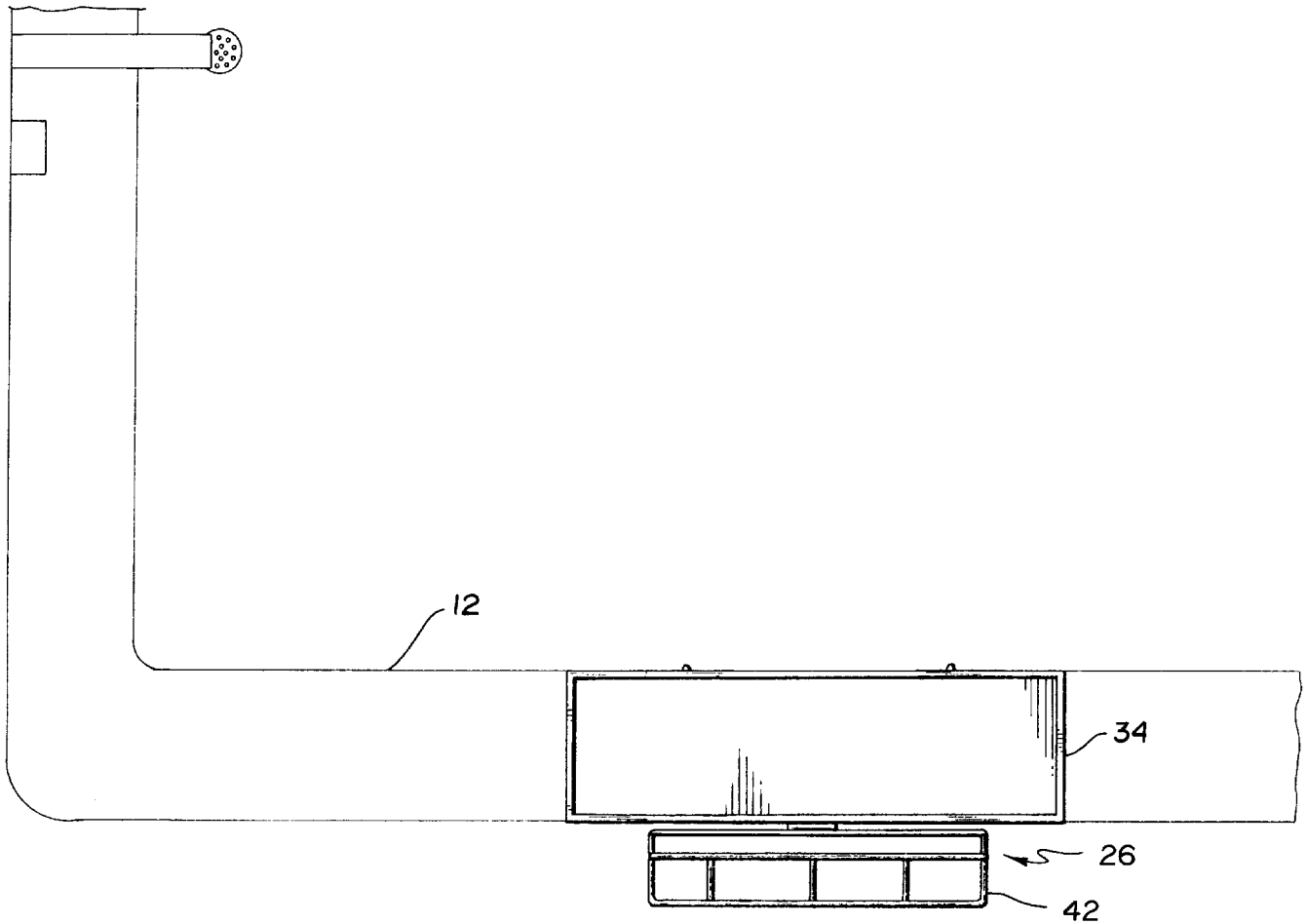
FIG. 2 is a top plan view of the bathtub caddy.
Figure 3:
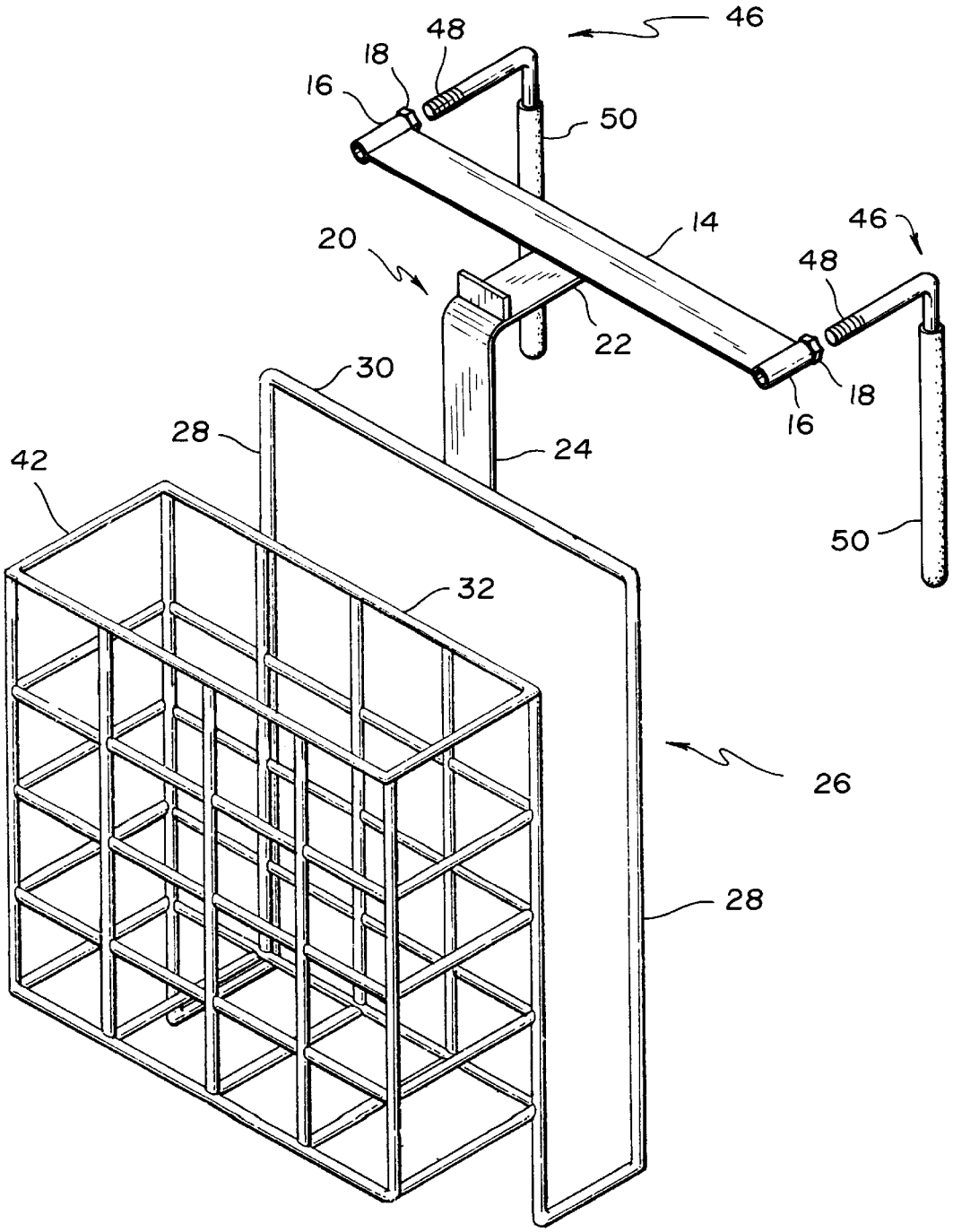
FIG. 3 is an exploded perspective view illustrating attachment of the locking arms.
Figure 4:
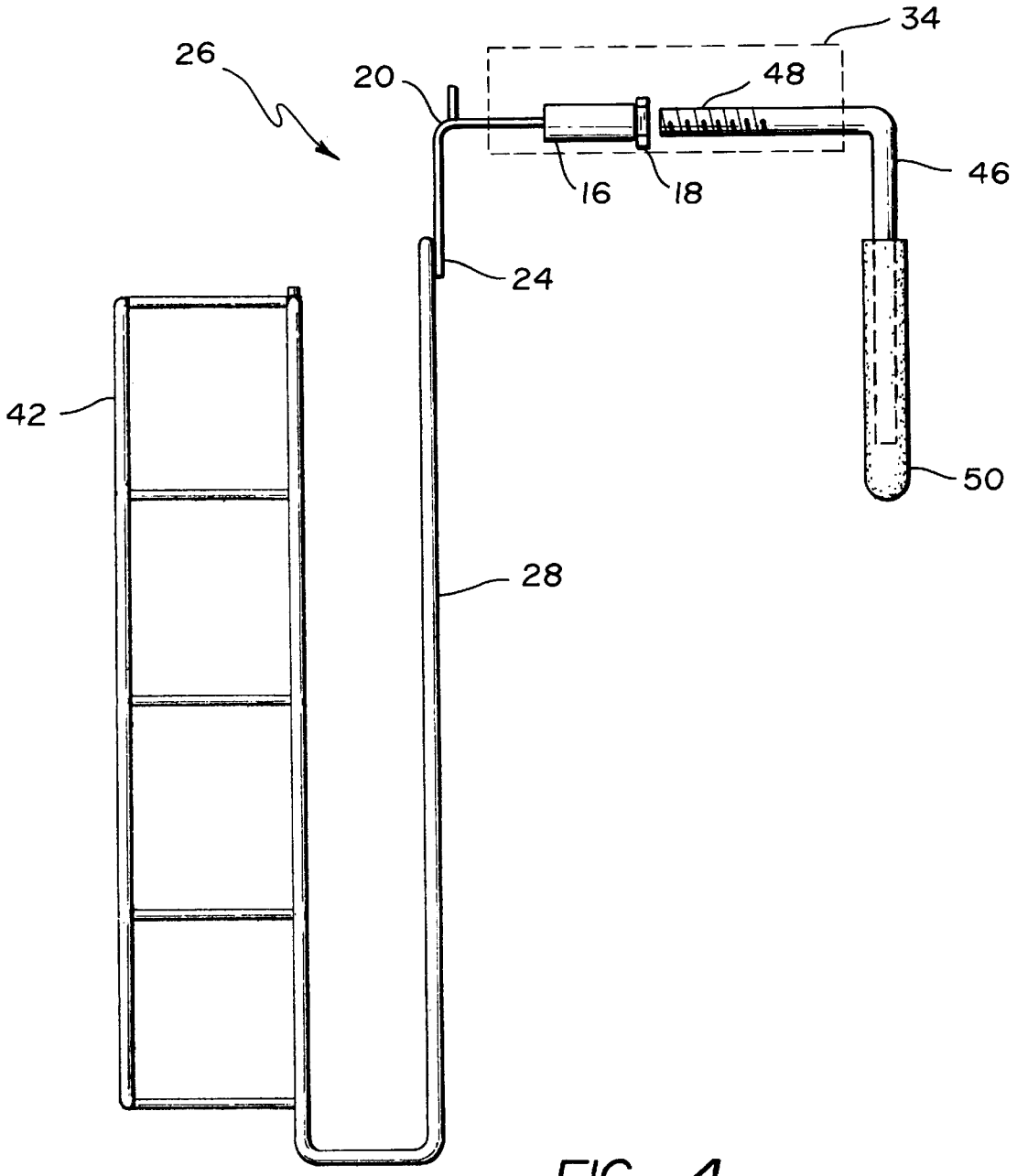
FIG. 4 is a side elevational view of the bathtub caddy.
Figure 5:
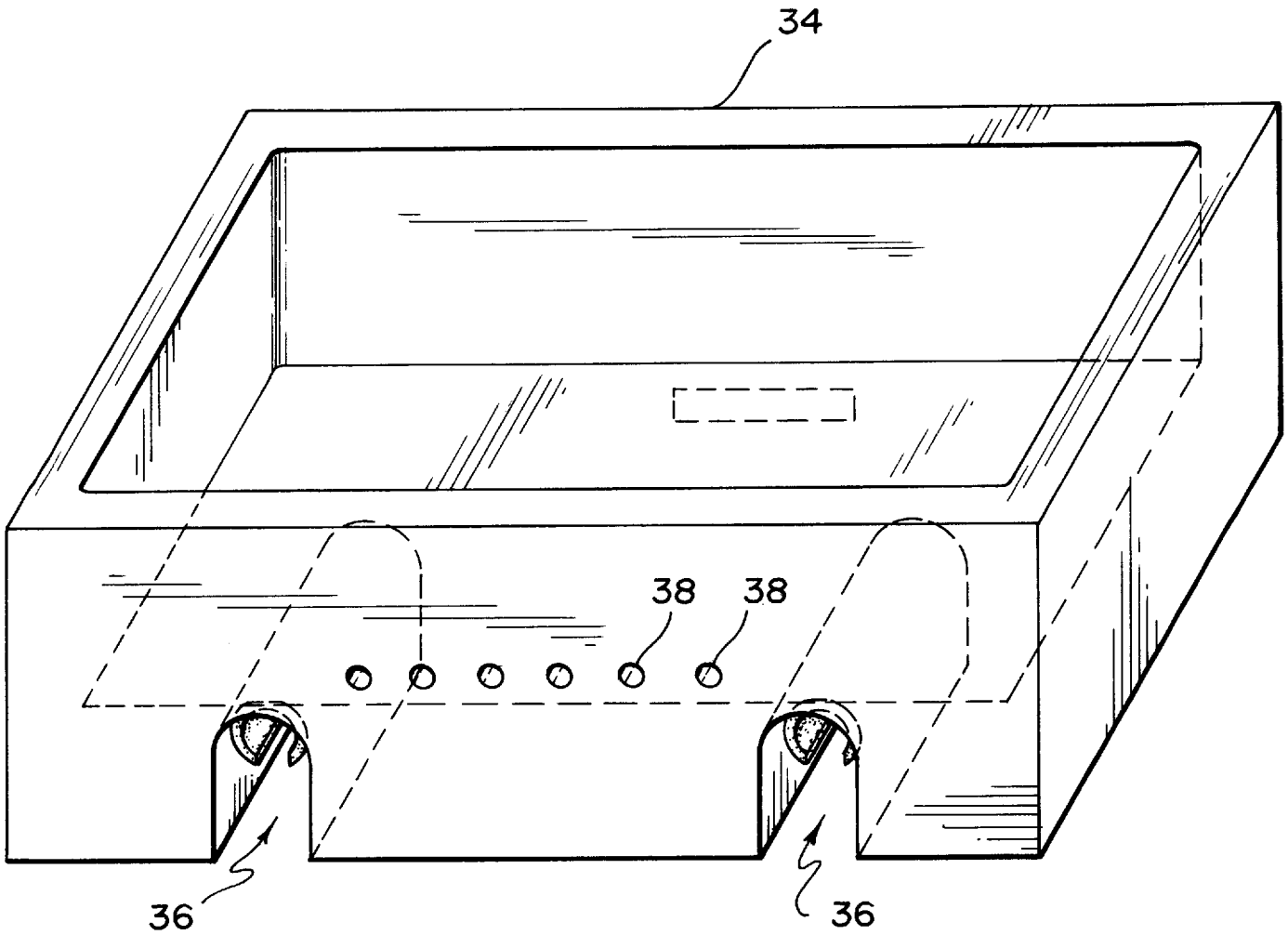
FIG. 5 is a perspective view of a tray used with the bathtub caddy.

Referring to the drawings and initially to FIG. 1, a bathtub caddy 10 is shown mounted on the side of a typical bathtub 12. The bathtub caddy 10 is designed to support a plurality of useful items alongside the bathtub 12. Referring additionally to FIGS. 2–4, the bathtub caddy 10 includes a base member 14 and a cross-member 20. The base member 14 has a generally elongated shape which defines two ends. A threaded coupling 16 is attached to each end of the base member 14. Each threaded coupling 16 also includes a locking nut 18 secured thereto. The cross-member 20 has an L-shaped configuration and includes a first end 22 and a second end 24. The cross-member 20 is oriented such that its first end 22 is attached to the central portion of the base member 14. Thus, the first end 22 of the cross-member 20 lies on the same plane as the base member 14, and the second end 24 of the cross-member 20 projects perpendicularly from the plane of the base member 14 in a downward direction. A pair of arrestors 46 is provided to assist in securing the bathtub caddy 10 to the side of a bathtub 12. Each arrestor 46 is generally L-shaped and includes a threaded end 48. The threaded ends 48 of the arrestors 46 are designed such that they may engage the threaded couplings 16 secured to the base member 14. Thus, the bathtub caddy 10 may be adjusted to fit various sizes of bathtubs 12. As seen in FIG. 3, the arrestors 46 may be provided with a protective coating 50 designed to prevent chemical reactions, such as oxidation, with water contained in the bathtub 12.

A frame assembly 26 is secured to the second end 24 of the cross-member 20. The frame assembly 26 includes a plurality of U-shaped members 28 which are spaced a predetermined distance from each other. Each U-shaped member 28 has a first end and a second end. As illustrated in the figures, only two (2) U-shaped members 28 are used in the frame assembly 26. It should be noted, however, that additional U-shaped members 28 could be added. A first arm 30 is horizontally oriented and attached to the second end 24 of the cross-member 20. The orientation of the first arm 30 also facilitates attachment to the first end of each of the U-shaped members 28. A second arm 32 is horizontally oriented and attached to the second ends of the U-shaped members 28.

A tray 34 is removably secured to the base member 14 and provides storage area for bath accessories and items that may otherwise be wetted. The tray 34 contains a plurality of apertures 38 on the surface thereof to facilitate drainage of water 40 that accumulates when items such as a razor or soap are placed therein. While the apertures 38 are shown on one side of the tray 34, it should be appreciated that they may also be disposed on the bottom surface of the tray 34. Additionally, the bottom surface of the tray 34 may be provided with an incline to further urge water 40 through the apertures 38. The bottom surface of the tray 34 also includes a pair of recesses 36. The recesses 36 are specifically molded and sized for engaging the threaded couplings 16 in order to retain the tray 34.

A rack 42 is provided for storage of items which should not get wet, such as magazines, newspapers, or and other reading materials. The rack 42 is secured to the second arm 32 of the frame assembly 26. As seen in the figures, the rack 42 has a wire frame construction. While providing sufficient support for reading materials, the wire frame construction also prevents collection of water within the rack 42.

The bathtub caddy 10 may be constructed in a variety of manners and of a variety of materials. For example, a metal wire may be used and decoratively painted. Preferably, plastics having the required strength may be used. If plastics are used, the need for a protective coating 50 is eliminated since the plastic won't normally react with water.

It is to be understood that the present invention is not limited to the sole embodiment described above, but encompasses any and all embodiments within the scope of the following claims.

I claim:

1. A caddy for supporting a plurality of items comprising:

a base member;

a cross-member having an L-shaped configuration and including a first and second end, said cross-member being oriented such that said first end is attached to said base member at a location proximate the midpoint of said base member, and said second end projecting perpendicularly from the plane of said base member;

a frame assembly including:

at least two U-shaped members spaced a predetermined distance from each other, each of said U-shaped member having a first end and a second end, a first arm, horizontally oriented and attached to the second end of said cross-member, said first arm being further attached to the first ends of said at least two U-shaped members, and a second arm horizontally oriented and attached to the second ends of said at least two U-shaped members;

a tray for receiving a plurality of items;

means for removably securing said tray to said base member;

a rack secured to said second arm and said at least two U-shaped members; and means for adjustably securing said caddy to a bathtub.

2. A caddy as recited in claim 1 wherein said frame assembly includes two U-shaped members.

3. A caddy as recited in claim 1 wherein said rack has a wire frame construction.

4. A caddy as recited in claim 1 wherein said tray contains a plurality of a apertures for directing water into the bathtub.

5. A caddy as recited in claim 1 wherein said rack is constructed from plastic.

6. A caddy as recited in claim 1 wherein said means for adjustably securing comprises:

a pair of threaded couplings, each of said threaded couplings being secured to one end of said base member;

a pair of L-shaped arrestors, each of said arrestors containing a threaded end suited for engaging the threads of a corresponding one of said threaded couplings; and a locking nut coupled to each of said threaded couplings for retaining a corresponding one of said arrestors.

7. A caddy as recited in claim 6 wherein said means for removably securing comprises a pair of recesses disposed on the underside of said tray, said recesses being positioned in registry with said threaded couplings, and said recesses being sized for releasably engaging said threaded couplings.

8. A caddy as recited in claim 6 wherein said arrestors include a layer of protective coating to reduce chemical reactions with water from the bathtub.

* * * * *